US012747934B2

(12) United States Patent
Pell

(10) Patent No.: US 12,747,934 B2
(45) Date of Patent: Sep. 29, 2026

(54) ARROW TIP

(71) Applicant: Ozcut, Inc., Peru, IL (US)

(72) Inventor: Matt Pell, Peru, IL (US)

(73) Assignee: Ozcut, Inc., Peru, IL (US)

( * ) Notice: Subject to any disclaimer, the term of this patent is extended or adjusted under 35 U.S.C. 154(b) by 179 days.

(21) Appl. No.: 18/823,228

(22) Filed: Sep. 3, 2024

(65) Prior Publication Data

US 2025/0093135 A1 Mar. 20, 2025

Related U.S. Application Data

(60) Provisional application No. 63/538,766, filed on Sep. 15, 2023.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/582, 583, 584
See application file for complete search history.

(56) References Cited

U.S. PATENT DOCUMENTS 3,756,600 A * 9/1973 Maleski ..... F42B 6/08 473/584
4,381,866 A * 5/1983 Simo ..... F42B 6/08 30/337
5,322,297 A * 6/1994 Smith ..... F42B 6/08 473/583
5,417,440 A * 5/1995 Barrie ..... F42B 6/08 473/584
5,458,341 A * 10/1995 Forrest ..... F42B 6/08 473/583
5,564,713 A * 10/1996 Mizek ..... F42B 6/08 473/583
5,820,498 A * 10/1998 Maleski ..... F42B 6/08 473/584
5,857,930 A * 1/1999 Troncoso ..... F42B 6/08 473/583
6,077,180 A * 6/2000 Adams, Jr. ..... F42B 6/08 473/584
6,171,206 B1 * 1/2001 Liechty, II ..... F42B 6/08 473/583
6,200,237 B1 * 3/2001 Barrie ..... F42B 6/08 473/583
6,217,467 B1 * 4/2001 Maleski ..... F42B 6/08 473/583
6,287,223 B1 * 9/2001 Liechty, II ..... F42B 6/08 473/583
6,758,774 B2 * 7/2004 Liechty, II ..... F42B 6/08 473/589
7,179,182 B2 * 2/2007 Summers ..... F42B 6/08 473/583

(Continued)

*Primary Examiner* — Alexander R Niconovich
(74) *Attorney, Agent, or Firm* — Justin Lampel

(57) ABSTRACT

An arrow tip is provided. The arrow tip has a removable collar portion and a main body portion. The removable collar portion has swinging side blades. The main body portion may also have blades. The swinging side blades are secured to the removable collar portion and wherein the removable collar portion is removable from the main body portion of the arrow tip. The removable collar allows a user to replace the swinging blades while reusing the main body portion of the arrow tip.

16 Claims, 2 Drawing Sheets

(56) References Cited

U.S. PATENT DOCUMENTS

| | | | | |
|---|---|---|---|---|
| 7,682,271 | B2 * | 3/2010 | Rager | F42B 6/08 473/583 |
| 7,713,151 | B2 * | 5/2010 | Fulton | F42B 6/08 473/583 |
| 7,713,152 | B1 * | 5/2010 | Tentler | F42B 6/08 473/583 |
| 8,062,155 | B2 * | 11/2011 | Butcher | F42B 6/08 473/578 |
| 8,118,694 | B1 * | 2/2012 | Oliveira | F42B 6/08 473/583 |
| 8,529,385 | B1 * | 9/2013 | Lee | F42B 6/08 473/583 |
| 8,801,552 | B2 * | 8/2014 | Miles | F42B 6/08 473/583 |
| 8,911,310 | B2 * | 12/2014 | Lee | F42B 6/08 473/583 |
| 8,974,328 | B1 * | 3/2015 | Sullivan | F42B 6/08 473/583 |
| 9,028,349 | B2 * | 5/2015 | Budris | F42B 6/08 473/583 |
| 9,091,515 | B1 * | 7/2015 | Lee | F42B 6/08 |
| 9,097,500 | B1 * | 8/2015 | Addleman | F42B 10/00 |
| 9,115,962 | B1 * | 8/2015 | Weaver | F42B 6/08 |
| 9,194,673 | B1 * | 11/2015 | Lee | F42B 6/08 |
| 9,267,773 | B2 * | 2/2016 | Mizek | F42B 6/08 |
| 9,303,963 | B1 * | 4/2016 | Ford | F42B 6/08 |
| 9,372,056 | B2 * | 6/2016 | Sullivan | F42B 12/34 |
| 10,180,312 | B2 * | 1/2019 | Asbill | F42B 6/08 |
| 10,288,392 | B2 * | 5/2019 | Haas | F42B 6/08 |
| 10,295,316 | B2 * | 5/2019 | Wukie | F42B 6/08 |
| 10,352,667 | B2 * | 7/2019 | Salvino | F42B 12/34 |
| 10,458,767 | B2 * | 10/2019 | Buchanan | F42B 6/08 |
| 10,591,262 | B1 * | 3/2020 | Osborn | F42B 6/08 |
| 10,746,514 | B1 * | 8/2020 | Stacy | F42B 6/08 |
| 10,809,044 | B2 * | 10/2020 | Perry | F42B 6/08 |
| 11,740,060 | B2 * | 8/2023 | Forrest | F42B 6/04 473/583 |
| 11,859,960 | B2 * | 1/2024 | Forrest | F42B 6/08 |
| 12,140,409 | B2 * | 11/2024 | Barnette | F42B 6/08 |
| 12,264,904 | B2 * | 4/2025 | Bowmar | F42B 6/08 |
| 2003/0073525 | A1 * | 4/2003 | Liechty, II | F42B 6/08 473/582 |
| 2004/0198540 | A1 * | 10/2004 | Mizek | F42B 6/08 473/583 |
| 2015/0168112 | A1 * | 6/2015 | Hollars | F42B 12/34 473/583 |

* cited by examiner

ARROW TIP

REFERENCE TO RELATED APPLICATIONS

This application claims priority to U.S. Provisional Application No. 63/538,766 titled ARROW TIP which was filed on Sep. 15, 2024, the entire contents of which are incorporated by reference herein.

BACKGROUND OF THE INVENTION

An arrow tip is provided. The arrow tip has a removable collar portion and a main body portion. The removable collar portion has swinging side blades. The main body portion may also have blades. The swinging side blades are secured to the removable collar portion and wherein the removable collar portion is removable from the main body portion of the arrow. The removable collar allows a user to replace the swinging blades while reusing the main body portion of the arrow.

Patents related to arrow tips have been granted in the past. For example, U.S. Pat. No. 10,746,514 to Stacy discloses a broadhead arrow tip with independent suspension expandable blades. It has an elongated ferrule body with a first slot oriented lengthwise therein which bifurcates the front end into two portions. A second slot oriented lengthwise within the body is situated between the first slot and the body's back end. The second slot is open to the body's side surfaces and is transversely wider than the first. Expandable blades are independently suspended within the second slot by a retaining pin passing through oblong apertures through an end of the blades. The blade ends have a thickness of one-third or less than the transverse width of the second slot. A threaded tip is securable on a threaded surface at the body's front end. Securement of the tip deflects the front portions toward one another, narrowing the first slot which holds the blades in a stowed positioned when placed therein.

Further, U.S. Pat. No. 6,171,206 to Liechty discloses blade-opening arrowheads having pivotal blades, wherein each blade is hingedly connected at one blade end to an arrowhead body by a hinge pin. Each blade may be disposed at an angle relative to the central axis of the arrowhead body. Each blade freely rotates in a plane from a retracted in-flight position to an open position when penetrating an object where the other opposing blade end rotates away from the arrowhead body such that the sharp cutting edges of the blades are exposed at a full cutting diameter when the blades are in the open position. When in the retracted position a blade is securely held selectively adjacent to the arrowhead body by frictional engagement from methods independent of, or not dependent upon, the use of an element or elements in addition to that individual cutting blade, its hinge pin and its blade slot.

However, these patent documents fail to disclose a removable collar portion having swing blades used in conjunction with an arrow tip.

SUMMARY OF THE INVENTION

An arrow tip is provided. The arrow tip has a removable collar portion and a main body portion. The removable collar portion has swinging side blades. The main body portion may also have blades. The swinging side blades are secured to the removable collar portion and wherein the removable collar portion is removable from the main body portion of the arrow. The removable collar allows a user to replace the swinging blades while reusing the main body portion of the arrow.

An advantage of the present removable collar of an arrow is that the present removable collar allows a user to replace the collar and swing blades while retaining and reusing the main body of the arrow tip.

And an advantage of the present removable collar of the arrow is that the present removable collar portion allows a user to select from different collars having different designed swing blades.

Yet another advantage of the present removable collar of an arrow is that the present removable collar allows a user to replace the collar with a collar having an alternative number of blades.

Still another advantage of the present removable collar of an arrow is that the present removable collar portion allows a user to use the arrow without any collar and swing blades attached.

Yet another advantage of the present removable collar of an arrow is that the present removable collar may have locking bumps that lock the swing blades in the forward position during flight and, upon impact with a target, unlock allowing the swing blades to swing backward.

For a more complete understanding of the above listed features and advantages of the present removable collar of an arrow tip reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

Figure 1:
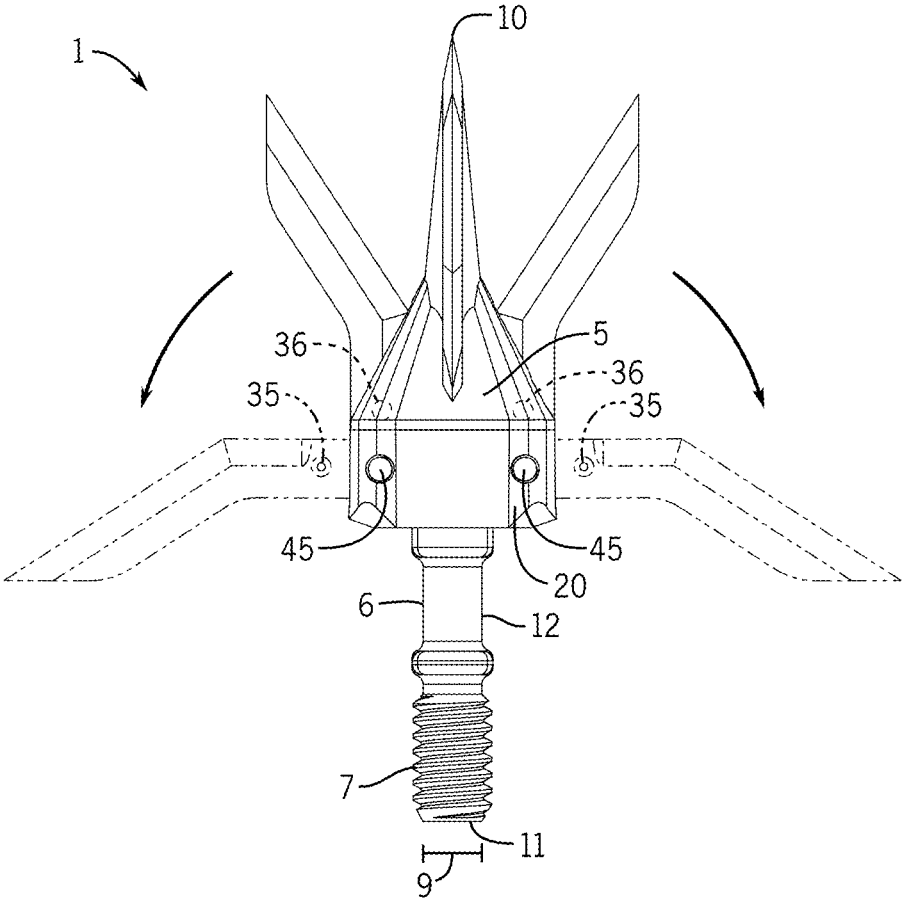
FIG. 1 illustrates a side view of the arrow tip with the removable collar having swing blades attached.

An arrow tip is provided. The arrow tip has a removable collar portion and a main body portion. The removable collar portion has swinging side blades. The main body portion may also have blades. The swinging side blades are secured to the removable collar portion and wherein the removable collar portion is removable from the main body portion of the arrow. The removable collar allows a user to replace the swinging blades while reusing the main body portion of the arrow.

Referring now to the figures, in an embodiment, an arrow tip 1 having an attachment mechanism. In an embodiment the attached mechanism is a removable collar 20 is provided. The arrow tip 1 may be secured to the shaft 2 of an arrow 3. The arrow tip 1 may have a front 10 and a back 11. The arrow tip 1 may further have a side 12. In an embodiment, the side 12 of the arrow tip 1 may be generally cylindrical. The side 12 of the arrow tip 1 may have a main body section 5 (with extensions such as blades extending outward) and a more narrow, cylindrical, shaft 6. The number and shape of blades extending outward from the main body section 5 of the arrow tip 1 may be altered. The more narrow, cylindrical shaft 6 may have a threaded member 7 which may be screwed into an opening 8 of the first end 30 of the shaft 2 of the arrow 3. In particular, the threaded member 7 may be removably secured within the opening 8 (having a corresponding threaded member) of the first end 30 of the shaft 2 of the arrow 3.

In an embodiment, the main body, attachment mechanism, and movable elements are constructed from one or more materials selected from metals, alloys, composites, or polymers, and wherein the assembly can be manufactured by machining, molding, or additive manufacturing.

In an embodiment, the more narrow, cylindrical, shaft 6 of the arrow tip 1 may have a diameter 9. The diameter 9 may be smaller than a diameter 15 of the opening 8 of the first end 30 of the shaft 2 of the arrow 3 so that the shaft 6 of the arrow tip 1 may be removably secured within the opening 8 of the shaft 2 of the arrow 3 during use.

Figure 2:
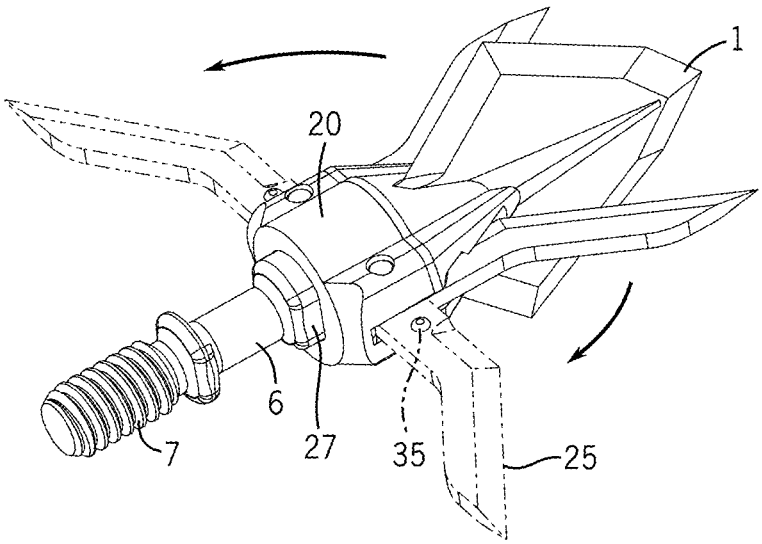
FIG. 2 illustrates a perspective view of the arrow tip of FIG. 1.
Figure 4:
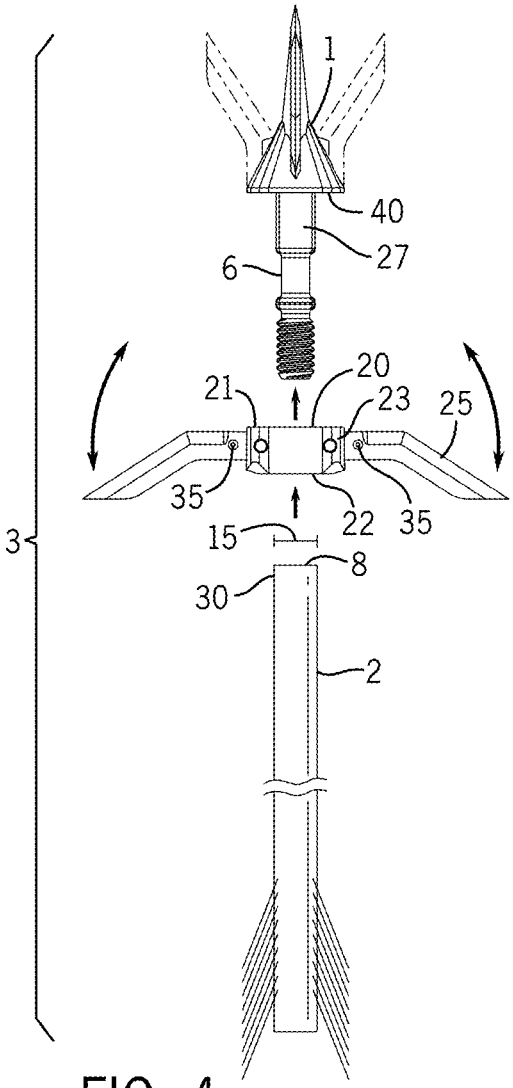
FIG. 4 illustrates an exploded view of the arrow tip with the removable collar having the swing blades removed from the shaft of the arrow tip.
Figure 5:
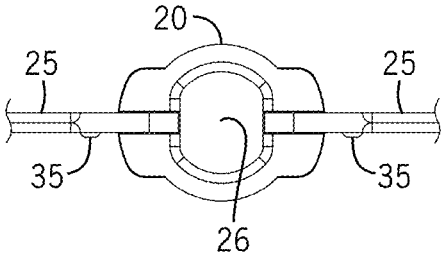
FIG. 5 illustrates a front view of the removable collar having attached swing blades.

In an embodiment, the broadhead arrow tip 1 has a removable collar 20. The removable collar 20 may have a front 21, a back 22, and a side 23. The removable collar 20 may be a ring, having a passageway 26 from the front 21 to the back 22. In use, the shaft 6 of the arrow tip 1 passes through the opening 26 of the removable collar 20. The shaft 6 is then secured within the opening 8 of the first end 30 of the arrow 3 so that the removable collar 20 is located between the front 30 of the arrow shaft 2 and the main body 5 of the broadhead arrow tip 1 as shown in FIG. 4. In an embodiment, as shown in FIGS. 2 and 5, the passageway 26 may not be circular. Instead, the passageway 26 may be generally oval or some other shape so that when the removable collar 20 is secured to a base 27 of the main body portion 5 of the arrow tip 1 the removable collar 20 will not rotate. As a result, the arrow 3 is more stable during flight and upon impact.

The front end 21 of the removable collar 20 may contact the back end 40 of the main body 5 of the arrow tip 1. More specifically, the back end 40 of the main body 5 may prevent the removable collar 20 from moving forward while the removable collar 20 is secured on the arrow 3. The back end 22 of the collar 20 may be tapered inward and may contact the front 30 end of the arrow shaft 2. In an embodiment, a screw 50 may allow the collar 20 to be tightly secured to the shaft 6 of the arrow tip 1 during use. If a user removes the screw 50 of the collar 20, a user may then slide the removable collar 20 away from the shaft 6 of the arrow tip 1 (as shown in FIG. 4) to replace the collar 20 with an alternative collar or new collar 20.

Figure 3:
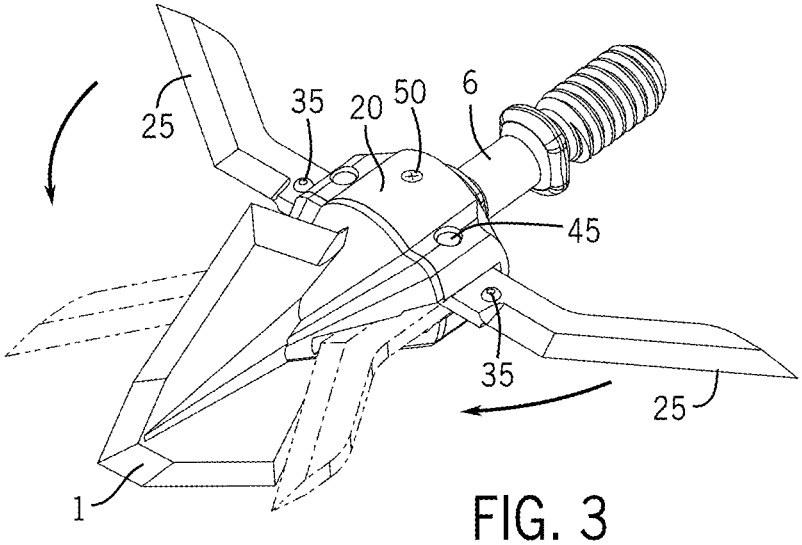
FIG. 3 illustrates a front perspective view of the arrow tip of FIG. 1.

Located on the side 23 of the removable collar 20 of the arrow tip 1 may be a movable element. In an embodiment the movable element is a swing blade 25. It should be noted that the removable collar illustrated in the figures has two blades; however, the present removable collar may be made with any number of swing blades. In one embodiment, the swing blades 25 may generally be first positioned in a forward orientation (as shown in broken lines in FIG. 3) and may move to a backward orientation (as shown in solid lines in FIG. 3) when the arrow tip 1 strikes a target. In the forward folded orientation of FIG. 1, the arrow tip is more arrow dynamic, therein increasing the speed of the arrow 3 and accuracy during flight travel. In the backward orientation during impact, the swing blades 25 may create a bigger impact site on the target. In an embodiment, the removable collar 20 may be of various shapes (such as circular, oval, square, rectangular, etc) and may have numerous blades attached.

In an embodiment, each swing blade may have a connecting element. In an embodiment the connecting element is a pivot pin 45 which connects the swing blade 25 to the removable collar 20. The pivot pin 45 allows the swing blade 25 to rotate from the forward orientation of FIG. 1 to the back orientation of FIG. 3.

In an embodiment, each of the swing blades 25 may have a locking mechanism. In an embodiment the locking mechanism is an extended bump 35. The extended bump 35 is preferably located on the swing blade 25 near the point of contact (the pivot pin 45) between the swing blade 25 and the removable collar 20. A correspondingly similar shaped indented area 36 located within the interior surface of the main body 5 of the arrow tip 1 receives the extended bump 35 and locks the swing blades 25 in the forward orientation of FIG. 1 by friction. When the arrow tip 1 strikes a target, the force of the target on the swing blades 25 is enough to overcome the friction to release the extended bumps 35 from the indented area 36 within the main body 5 of the arrow tip 1. The swing blades 25 then swing backward into the orientation of FIG. 3. In one alternative embodiment, the swing blades 25 may not rotate backward as a result of a pivot pin 45 as discussed above, but may instead slide backward on a rail upon impact.

When a user uses the arrow 3, the collar 20 and swing blades 25 may become damaged and may need to be replaced. To replace the collar 20 and swing blades 25, while keeping the main arrow tip 1, a user unscrews the arrow tip 1 from the shaft 2 of the arrow 3 by removing the shaft 6 of the arrow tip 1 from the opening 8 of the arrow shaft 2. Once removed, a user may unscrew the screw 50 of the collar 20 and may then remove the collar 20 (which has the swing blades 25 permanently attached) from the shaft 6 of the arrow tip 1. Once removed, a brand new (or alternative) collar 20 having new swing blades 25 may be inserted and screwed onto the shaft 6 of the arrow tip 1 and the arrow tip 1 (with the new collar 20 attached) may then be secured within the opening 8 of the shaft 2 of the arrow 3. A user may therefore reuse the arrow tip 1 by merely replacing the collar 20 and swing blades 25; whereas in other prior art arrows, the collar is permanently attached to the arrow tip and the entire arrow tip must be replaced if the swing blades are damaged.

In a method of use, a user may attach the removable attachment mechanism with movable elements to a main arrow tip body, secure the assembly to an arrow shaft and replace the attachment mechanism as needed without replacing the main arrow tip body.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. An arrow tip assembly having an attachment mechanism comprising:

a main body defining a shaft extending rearwardly from the main body;

an attachment mechanism configured to be removably secured to the main body, the attachment mechanism having a passageway;

wherein the shaft of the main body passes through the passageway of the attachment mechanism;

at least one movable element connected to the attachment mechanism, wherein the movable element transitions from a forward-facing first position substantially aligned with a longitudinal axis of the shaft to a rearward-facing second position upon contact of the main body with a target;

wherein the attachment mechanism remains fixed in a static axial position relative to the main body during the transition of the at least one movable element from the first position to the second position; and wherein the attachment mechanism is configured to be detached from and replaced on the main body by an end user, without removal or alteration of the main body, upon removal of a single fastener securing the attachment mechanism to the shaft.

2. The arrow tip assembly of claim 1 further comprising:

a connecting element located within the attachment mechanism, wherein the connecting element allows the at least one movable element to pivot from the first position to the a second position during flight or upon impact.

3. The arrow tip assembly of claim 1 wherein the passageway of the attachment mechanism is non-circular.

4. The arrow tip assembly of claim 1 further comprising: a blade located on the main body.

5. The arrow tip assembly of claim 1 further comprising:

a threaded member located on the shaft of the main body wherein the threaded member removably engages with a corresponding threaded member located within a shaft of an arrow.

6. The arrow tip assembly of claim 1 further comprising: a locking mechanism on the at least one movable element that engages with the main body the locking mechanism comprising a protrusion on the at least one movable element configured to engage a corresponding recess defined in the main body, the protrusion and recess cooperating to retain the at least one movable element in the first position by friction, the protrusion configured to disengage from the recess upon application of external force to the at least one movable element.

7. The arrow tip assembly of claim 1 wherein the main body, attachment mechanism, and at least one movable element are constructed from one or more materials selected from metals, alloys, composites, or polymers, and wherein the main body is manufactured by machining, molding, or additive manufacturing.

8. A method for using an arrow tip assembly comprising: providing an arrow tip assembly having an attachment mechanism comprising:

i) a main body defining a shaft extending rearwardly from the main body;

ii) an attachment mechanism configured to be removably secured to the main body, the attachment mechanism having a passageway; wherein the shaft of the main body passes through the passageway of the attachment mechanism;

iii) at least one movable element connected to the attachment mechanism, wherein the moveable element transitions from a forward-facing first position substantially aligned with a longitudinal axis of the shaft to a rearward-facing second position upon contact of the main body with a target;

wherein the attachment mechanism remains fixed in a static axial position relative to the main body during the transition of the at least one movable element from a first position to the second position;

wherein the attachment mechanism is configured to be detached from and replaced on the main body by an end user, without removal or alteration of the main body, upon removal of a single fastener securing the attachment mechanism to the shaft; and temporarily securing the attachment mechanism to the main body.

9. An arrow tip assembly having an attachment mechanism comprising:

a main body defining a shaft extending rearwardly from the main body;

an attachment mechanism configured to be removably secured to the main body, the attachment mechanism having a non-circular passageway;

wherein the shaft of the main body passes through the passageway of the attachment mechanism;

at least one movable element connected to the attachment mechanism, wherein the movable element transitions from a first position to a second position upon contact of with a target;

wherein the attachment mechanism remains fixed in a static axial position relative to the main body during the transition of the at least one movable element from the first position to the second position; and wherein the attachment mechanism is configured to be detached from and replaced on the main body by an end user, without removal or alteration of the main body, upon removal of a single fastener securing the attachment mechanism to the shaft.

10. The arrow tip assembly of claim 9 wherein the at least one movable element connected to the attachment mechanism transitions from a forward-facing first position substantially aligned with a longitudinal axis of the shaft to a rearward-facing second position upon contact with a target.

11. The arrow tip assembly of claim 9 further comprising:

a connecting element located within the attachment mechanism, wherein the connecting element allows the at least one movable element to pivot from the first position to the second position during flight or upon impact.

12. The arrow tip assembly of claim 9 further comprising:

a locking mechanism on the at least one movable element that engages with the main body of the arrow tip, the locking mechanism comprising a protrusion on the at least one movable element configured to engage a corresponding recess defined in the main body, the protrusion and recess cooperating to retain the at least one movable element in the first position by friction, the protrusion configured to disengage from the recess upon application of external force to the at least one movable element.

13. The arrow tip assembly of claim 9 wherein a screw is used to removably secure the attachment mechanism to the main body.

14. The arrow tip assembly of claim 9 further comprising: a blade located on the main body.

15. The arrow tip assembly of claim 9 further comprising:

a threaded member located on the shaft of the main body wherein the threaded member removably engages with a corresponding threaded member located within a shaft of an arrow.

16. The arrow tip assembly of claim 9 wherein the main body, attachment mechanism, and at least one movable element is constructed from one or more materials selected from metals, alloys, composites, or polymers, and wherein the main body is manufactured by machining, molding, or additive manufacturing.

* * * * *